United States Patent [19]

Emmenthal et al.

[11] 4,368,714

[45] Jan. 18, 1983

[54] FUEL INJECTION APPARATUS

[75] Inventors: Klaus Emmenthal; Otto Schäfer, both of Wolfsburg; Rudolf-Helmut Strozyk, Helmstedt; Wolfgang Wehling, Brunswick, all of Fed. Rep. of Germany

[73] Assignee: Volkswagenwerk Aktiengesellschaft, Wolfsburg, Fed. Rep. of Germany

[21] Appl. No.: 932,493

[22] Filed: Aug. 10, 1978

[30] Foreign Application Priority Data

Aug. 30, 1977 [DE] Fed. Rep. of Germany ..... 2738992

[51] Int. Cl.[3] ..... F02M 69/08

[52] U.S. Cl. ..... 123/531; 123/533; 261/50 A

[58] Field of Search ..... 123/119 R, 139 AW, 34 R, 123/35, 119 D, 122, 179 G, 531, 533; 261/50 A, 51

[56] References Cited

U.S. PATENT DOCUMENTS

| | | | |
|---|---|---|---|
| 2,808,245 | 10/1957 | Grover | 261/51 |
| 2,889,904 | 6/1959 | Martinoli | 123/122 R |
| 3,198,498 | 8/1965 | Mennesson | 261/50 A |
| 3,608,532 | 9/1971 | Balloff | 123/139 AW |
| 3,756,208 | 9/1973 | Toda | 123/119 R |
| 3,760,780 | 9/1973 | Jordan . | |
| 3,841,283 | 10/1974 | Wood | 123/119 R |
| 3,861,366 | 1/1975 | Masaki . | |
| 3,900,014 | 8/1975 | Bondesen | 123/119 R |
| 3,957,026 | 5/1976 | Winkley | 123/179 G |
| 4,117,808 | 10/1978 | Takamiya | 123/75 B |
| 4,119,074 | 10/1978 | Masaki | 123/119 D |

FOREIGN PATENT DOCUMENTS

| | | | |
|---|---|---|---|
| 1243917 | 12/1967 | Fed. Rep. of Germany | 123/ |
| 2640941 | 3/1977 | Fed. Rep. of Germany . | |
| 994978 | 11/1951 | France . | |
| 1277391 | 10/1961 | France . | |
| 1361806 | 4/1964 | France . | |
| 854568 | 11/1960 | United Kingdom | 123/ |

*Primary Examiner*—Charles J. Myhre
*Assistant Examiner*—Carl Stuart Miller
*Attorney, Agent, or Firm*—Brumbaugh, Graves, Donohue & Raymond

[57] ABSTRACT

Apparatus for continuously injecting fuel into the intake pipe of an internal combustion engine. The apparatus has an air channel branching off from the intake pipe at a point ahead of an adjustable throttle flap; a fuel metering device supplying fuel to the air channel in dependence upon engine load; and a fuel delivery pump arranged to receive a fuel-air mixture from the air channel through a narrowed constriction. The fuel delivery pump is constructed to convey fuel mixed with air even under conditions of maximum engine load. The fuel metering device has fuel exit openings which are directed toward the narrow constriction of the air channel forming the fuel delivery pump inlet.

21 Claims, 3 Drawing Figures

$h_1$
$h_2$

FUEL INJECTION APPARATUS

BACKGROUND OF THE INVENTION

The present invention relates to a system for continuously injecting fuel into the intake line or pipe of an internal combustion engine. The system has an air channel branching off from the intake pipe ahead of an arbitrarily adjustable throttle flap. A fuel metering device supplies fuel to the air channel according to the engine load and a fuel delivery pump, supplying fuel to the injectors, receives fuel through a constriction or narrowed cross section in the channel.

One fuel injection system of this type is disclosed in the West German Patent No. 1,243,917. In this system fuel is supplied by a metering valve in proportion to the air passing into a chamber. A fuel injection pump is connected to receive fuel from this chamber via an inlet line and supplies the fuel, if necessary by way of a distributor, to a plurality of fuel injection nozzles arranged at the intake ducts associated with the several cylinders of the engine. The chamber into which the fuel is metered, and which is in communication with the intake pipe of the engine, has a substantially larger cross section than the inlet line of the injection or fuel delivery pump so that variations in volume flow through the pump cannot adversely affect the proportioning of fuel. In this system, the pump is designed to deliver substantially pure fuel under conditions of maximum engine load, and a mixture of air and fuel at small loads.

The advantage of this type of fuel injection system lies in its comparatively simple construction, since much of the precision apparatus involved in a conventional fuel injection system is avoided. However, the "preparation" of the fuel delivered, and also the responsiveness of such a fuel injection system to unsteady engine operating conditions, remain less than satisfactory. Since there is a comparatively low flow velocity in the chamber to which the fuel is supplied, because of the intended disassociation of this flow from the pressure fluctuations caused by the delivery pump, the time during which the fuel is transported from the moment of metering to the moment of injection is comparatively long. Therefore, the reaction time of the fuel injection system under rapidly changing engine operating conditions—with the resulting, corresponding variations in the fuel supply—is unacceptably slow.

SUMMARY OF THE INVENTION

An object of the present invention is to provide a fuel injection system of the type described above which, despite its simple structure, assures a favorable preparation of fuel and a quick response to unsteady operating conditions.

This object, as well as other objects which will become apparent from the discussion that follows, are achieved, according to the present invention, by constructing the system so that the fuel pump supplies a quantity of fuel mixed with air even under conditions of maximum engine load. Such a design of the fuel delivery pump insures that at all times—that is, both when the engine is under partial load and under extreme load—the pump will deliver a mixture of both fuel, metered in dependence upon the load, and air. Such a mixing of fuel with air under all operating conditions is particularly effective because the fuel delivery pump is included in the feed line and intimately mixes the two in the pumping operation. As a result, the fuel is satisfactorily "prepared" even before its injection.

The injection of this fuel-air mixture under pressure into the intake pipe or pipes associated with the individual cylinders of the engine does not even require an injection nozzle (nozzles) as in conventional fuel injection systems because, even at small flow rates, as the mixture is injected under pressure into the intake pipe it expands and is thereby finally divided and dispersed. This expansion is also attended by an evaporation of the liquid fuel contained in the fuel-air mixture, so that fuel preparation is further improved. In contrast, in conventional fuel injection systems which inject only liquid fuel, there have been great difficulties with fuel preparation, especially at small fuel flow rates, because the injection nozzles provided with special spraying means have failed to function properly at low flow rates.

According to another essential feature of the invention, the fuel metering device has fuel exit openings aligned with and directed toward the cross sectional channel constriction forming the fuel delivery pump inlet. This orientation of the fuel exit openings with the fuel pump inlet utilizes the exit momentum of the fuel to shorten its transport time. Thus, the fuel which is metered in dependence upon the instantaneous operation condition of the engine is placed directly into the feed line of the pump so that the reaction time of the injection system of the present invention to non-steady operating conditions is extremely short.

For a better understanding of the invention, together with other and further objects, reference is made to the following description taken in conjunction with the accompanying drawings, and its scope will be pointed out in the appended claims.

DESCRIPTION OF THE PREFERRED EMBODIMENTS

Figures 1, 2:
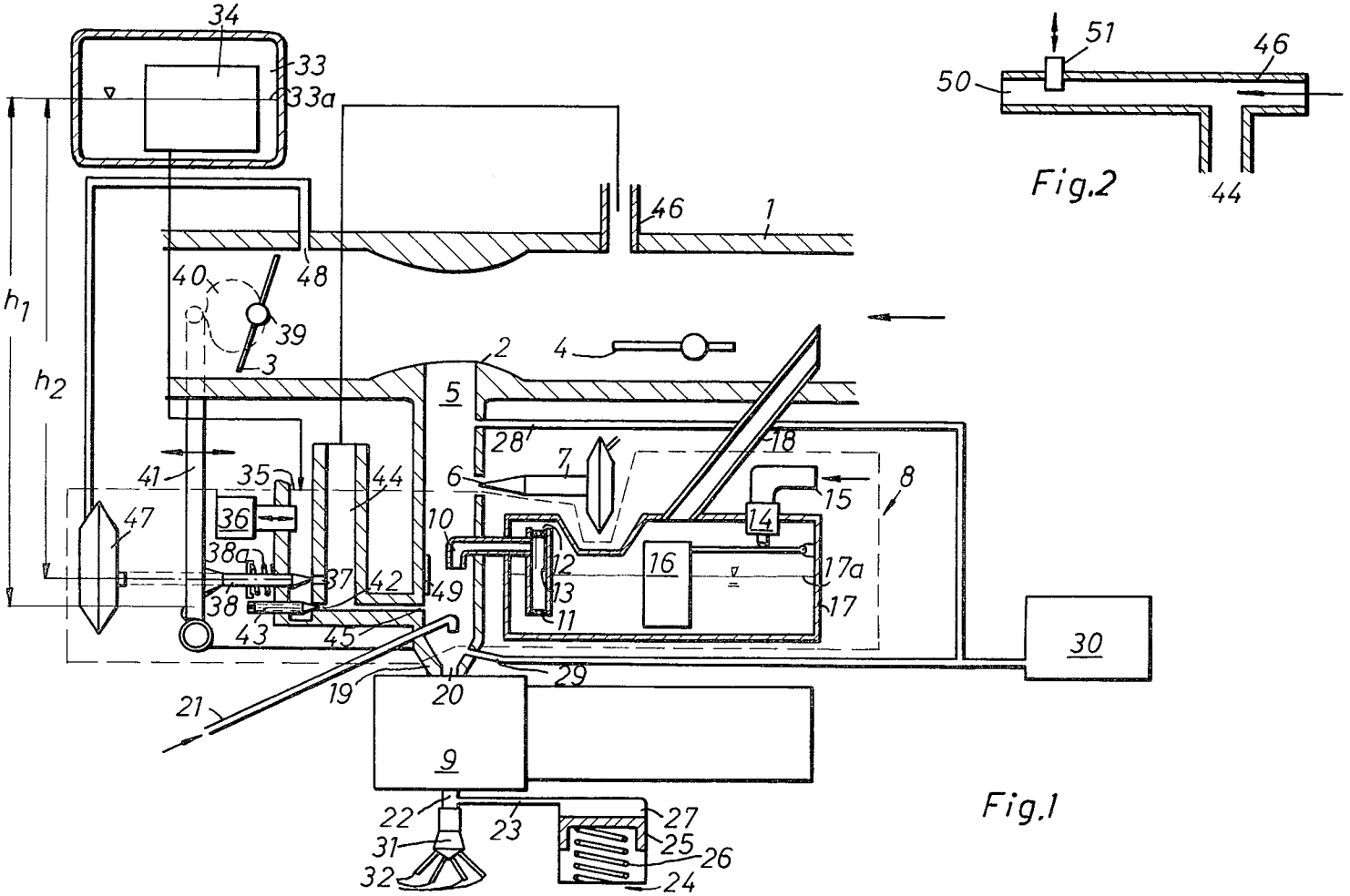
FIG. 1 is a schematic diagram showing a longitudinal section through one preferred embodiment of the fuel injection system according to the present invention.
FIG. 2 is a section diagram showing a modified, alternative form of a detail of the system embodiment of FIG. 1.

FIG. 1 shows an intake line or pipe 1 of a multicylinder, mixture-compressing internal combustion engine, such as a motor vehicle engine, having a venturi 2 arranged ahead of an arbitrarily adjustable throttle flap 3 and a starting choke flap 4 arranged ahead of the venturi. An air channel 5 branches off at the point of narrowest cross section of the venturi 2. This air channel is provided with a nozzle opening 6 supplying additional air for correction of the prevailing pressure in the air channel. The opening 6 is in communication with the atmosphere; its cross section is adjustable by a pneumatically or, if preferred, a mechanically controlled setting device 7, as a function of one or more parameters, such as intake manifold vacuum, characterizing the operating condition of the engine.

A fuel metering device, indicated generally by the box 8, meters the fuel into the air channel 5 according to the instantaneous operating condition of the engine. The fuel is then received, together with air, by a fuel delivery pump 9, arranged following a cross-sectional constriction 19 in the channel 5. The fuel pump 9 supplies the fuel and air via a line 22 and a distributor 31 to separate fuel injection lines 32. These injection lines 32 lead to the intake ports ahead of the inlet valves associated with the several cylinders of the engine to which the fuel-air mixture is delivered under continuous pressure. According to the invention, the pump 9 is constructed so that at all times—that is, even under conditions of maximum engine load when the maximum possible quantity of fuel is being metered into the air passage 5—it delivers a mixture of both fuel and air. This design is essential to ensure that the fuel is effectively "prepared" during the course of its delivery to the injection points.

The fuel metering device 8 in the exemplary embodiment shown in FIG. 1 is designed in a manner similar to a conventional carburetor. It includes a main fuel supply tube 10 connected to a float chamber 17 having a float 16 actuating a needle valve 14 for shutting off a fuel supply line 15 to maintain a fuel surface 17*a* at a constant level. The fuel enters the main supply tube 10 through a main nozzle 11 located below the fuel level 17*a* in the float chamber 17, while an air correction nozzle 12 and a mixer tube 13 supply air from the space over the fuel level 17*a* to the main supply tube 10. To aerate the float chamber 17, the latter is connected by way of a vent line 18 to a point along the intake line 1 ahead of the choke flap 4. The flow of fuel supplied by way of the main supply tube 10 is thus determined essentially by the negative pressure established in the air channel 5 which, in turn, corresponds substantially to the pressure at the narrowest point of the venturi 2 and depends upon the throughput of air through the intake line 1, and hence on the engine output.

As may be seen, the cross section of the air channel 5 is much larger than that of the inlet line connection 20 of the fuel delivery pump 9. In order to minimize reactions to volumetric flow fluctuations of the pump 9 upon the pressure in the air channel 5 and hence upon the fuel supplied by the fuel metering device 8, the flow velocity of the air in the air channel 5 is made comparatively low. Ordinarily, this would lead to a very long fuel transport lag from metering into the air channel 5 to injection into the engine intakes, substantially impeding or precluding trouble-free operation of the engine especially under unsteady operating conditions. According to the invention, in order to ensure good dynamic performance of an engine equipped with such a fuel injection system, the fuel exit openings or orifices of the fuel metering device 8 are aimed substantially toward the inlet line 20 of the fuel delivery pump 9. In this way the exit momentum of the fuel emerging from the fuel supply tubes is utilized to shorten the fuel transport time in the air channel 5, thereby substantially improving the response time of the injection system.

Thus, the main fuel supply tube 10, as well as an injection tube 21 connected to an acceleration pump (not shown) are aimed at the constricted cross section 19 of the air channel 5. The tube 21, which injects additional fuel into air channel 5 during accelerations of the engine, is curved like a hook at the end thereof that protrudes into the air channel. Alternatively to the form shown in the drawing, the injection tube 21 may instead open into the pressure line 22 or into the distributor 31 on the outlet side of the fuel delivery pump 9.

In addition to the main fuel supply tube 10 and the acceleration injection tube 21, the fuel metering device 8 has a fuel supply port 45 opening into the air channel 5 for idling and transition operation of the engine. This port communicates with a second air channel 44 whose cross section is substantially larger than the fuel supply port 45 (likewise for reasons of avoiding reactions to the fuel delivery pump 9 upon the metering of the fuel). The second air channel 44 is connected to the intake pipe 1 at a point 46 located between the starter choke flap 4 and the venturi 2. In this way, when the engine has warmed up and the choke flap 4 is wide open, the second air channel 44 is close to atmospheric pressure, whereas during a cold start and while the engine is warming up, a negative pressure is provided there due to the normal closing of the choke flap 4 in response to the engine temperature.

Two fuel supply ports 37 and 42 open into the second air channel 44. Their cross sections are variable by means of an adjustable conical pin 38 and an adjusting screw 43, respectively, thereby varying the supply of fuel from the fuel line 35 which is under a constant pressure. The fuel supply port 37 serves for fuel enrichment during transitional modes of operation of the engine, whereas the fuel port 42 meters the idling supply. In order to achieve fuel flow in the transition range appropriate to the operating condition of the engine, the setting of the conical pin 38 against a restoring spring 38*a* is controlled by a lever 41 actuated by a cam disc 40 of suitable shape fixed to the throttle shaft 39. Instead of this setting being directly dependent on the throttle flap 3, the conical pin 38 may be actuated by negative pressure, for which purpose a negative pressure chamber 47 is alternatively indicated, connected to an air line 48 that terminates at the inlet pipe 1 within the angular swing of the flap 3.

The fuel line 35 may be closed by means of a pneumatic or electromagnetic shut-off valve 36. The constant pressure in this line 35 may be made available by a second, suitably elevated float chamber 33, in which a float 34 maintains a constant fuel level 33*a*. Instead of this second float chamber 33, whose level is preferably adjustable to obtain an optimum idling mixture quality, the first float chamber 17 might alternatively be employed for fuel supply. In this case, however, the fuel supply ports 37 and 42 metering the fuel into the second air channel 44 have to be arranged at a correspondingly low level, in order to attain the necessary pressure heads $h_2$ and $h_1$, respectively. The fuel supply port 45 might then open into the region of the constriction 19 in the air channel 5 or into the inlet line 20 immediately ahead of the fuel delivery pump 9. Finally, instead of a float chamber, a pump with constant delivery pressure might be provided to supply the fuel to the fuel line 35. It may also be possible to combine the fuel supply ports 37 and 42, if desired, so that a single port would meter the fuel flow for both the idling and transitional modes of operation.

An enrichment of the fuel-air mixture delivered by pump 9 with fuel in the transitional range, namely at small apertures of the throttle flap 3, might alternatively be achieved without the fuel supply port 37 and its actuating mechanism, by suitable control of the flow of fuel let out of the main supply tube 10. For this purpose, the choke flap 4, independently of its operation during cold starting and warm-up, would also have to be set in a transitional mode position to augment the negative pressure in the venturi 2. A similar mechanism to that used for the conical pin 38 might be provided for this purpose, as for example a pneumatic setting device such as the negative pressure chamber 47, controlled by the negative pressure at the transmission port 48, or a mechanical setting device operated by a cam drive connected to the throttle shaft 39.

FIG. 2 shows another alternative mechanism for control of cold start and warm-up performance. Here the second air channel 44 is not directly connected to the intake pipe fitting 46 but branches off from a by-pass air line around the throttle, provided between the intake pipe connection 46 and a second connection 50 arranged on the intake pipe 1 following the throttle 3. This by-pass may be opened or closed by a slide 51 controlled according to the temperature of the engine. The slide 51 is open during cold start and warm-up, so that the engine is supplied with sufficient additional air for combustion in this mode. At the same time, the pressure is reduced in the second air passage 44, so that the quantities of fuel emerging from the supply ports 37 and 42 are increased. When warm-up is completed, the slide 51 closes the by-pass, so that the second air passage 44 is directly connected, as in the embodiment of FIG. 1, to the intake pipe fitting 46, and is at substantially atmospheric pressure.

Returning to FIG. 1, an air chamber 24 may be connected by way of a line 23 to smooth out pulsations of the fuel delivery pump 9 on its pressure side. The air chamber has a piston 25 biased by a spring and establishing a chamber volume 27 which varies as a function of the delivery pressure of the fuel pump 9. To prevent the piston travel from being lengthened by enlargement of the chamber volume at small engine loads, or small metered quantities of fuel, the spring 26 of air chamber 24 is so adjusted that the volume 27 is practically nil during such operating conditions. Use is thus made of the fact that the delivery pressure of the fuel pump 9 increases with increasing proportion of fuel in the volume delivered, thus providing a suitable signal for control purposes. Only at higher partial loads of the engine, when the flow of fuel supplied by the fuel metering device 8 increases, as does also the delivery pressure of fuel pump 9 in pressure line 22, will the chamber volume 27 of the air chamber 24 be increased, so that pulsations of the fuel pump 9, which are especially undesirable at high engine loads and speeds, are suitably equalized. Besides the air chamber 24 on the pressure side of fuel pump 9, similar air chambers 30 may be connected on the inlet side of the pump as well, for example by way of a line 29 in the region of the constriction 19 or by way of a line 28 ahead of the fuel metering device 8.

As is further shown in FIG. 1, a heating device 49, such as an electrically operated heating unit, may be provided in the air channel 5 following the main fuel supply tube 10 for heating and better preparation of the fuel-air mixture, especially during cold starting and warm-up of the engine. Alternatively, such a heating device might be arranged following the fuel pump 9. In any case, it need heat only a comparatively small flow (compared to the mass flow through intake pipe 1), and hence it will consume only comparatively minor amounts of energy. Electric resistance heating elements may preferably be used.

Figure 3:
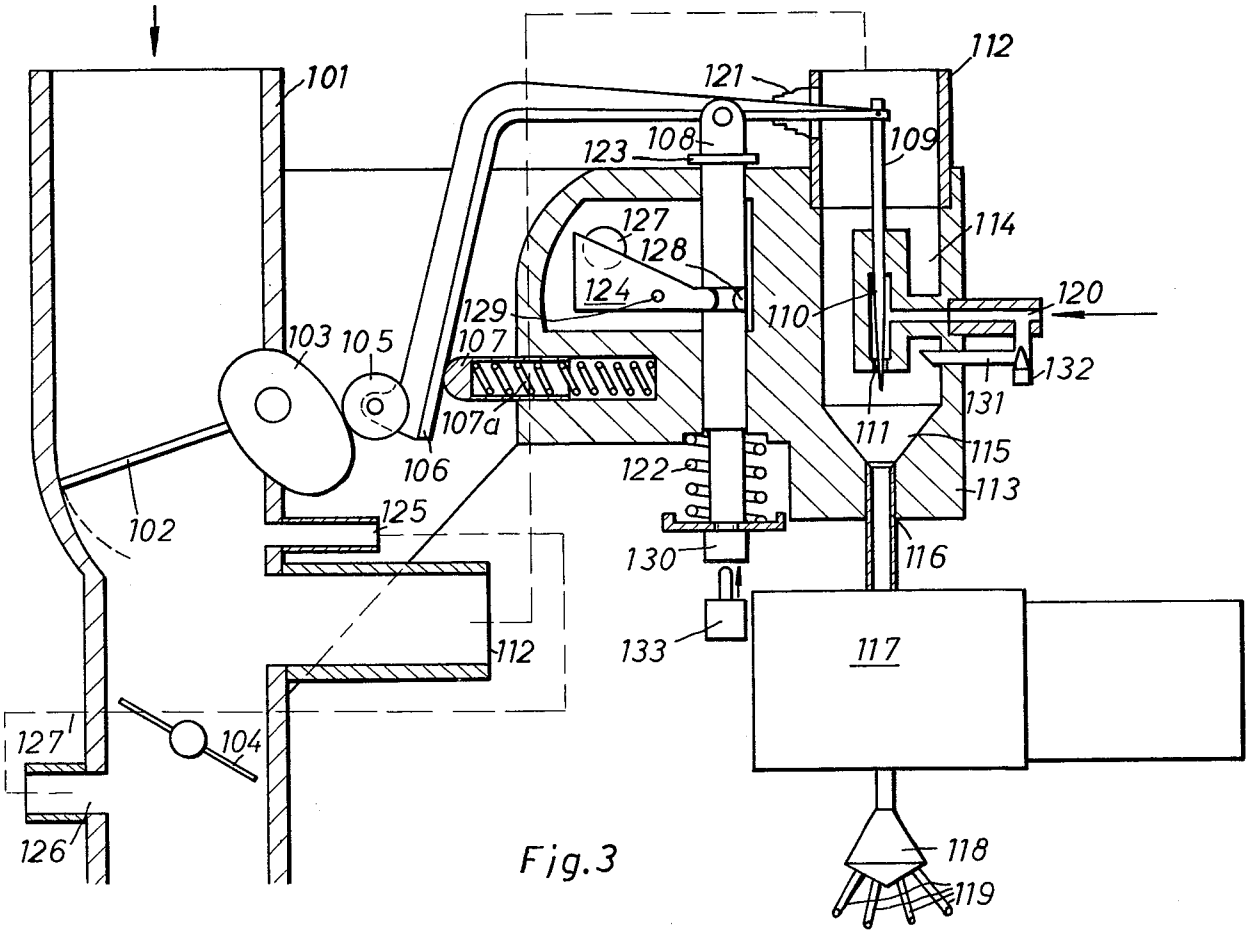
FIG. 3 is a schematic diagram showing another preferred embodiment of the fuel injection system according to the invention.

FIG. 3 shows a fuel injection system operating with air assistance, in which fuel metering is not determined as in the embodiment of FIG. 1, by a pressure signal picked up in a venturi, carburetor fashion, but by a pivoted baffle flap 102 arranged in the intake pipe 101. This baffle flap controls the flow of fuel to be metered into the air delivered by a pump with the aid of a cam mechanism and a conical nozzle pin. As may be seen in FIG. 3, the flap is pivoted in the intake pipe ahead of an arbitrarily adjustable throttle flap 104, a cam 103 being mounted on the pivot of the baffle flap. The baffle flap 102 is deflected in proportion to the air throughput in the intake pipe 101 and transmits this deflection by means of cam 103 and a cam follower 105 rolling against it to a lever 106 pivoted on a rod 108. The lever 106 is pressed against the cam 103 by a sleeve 107 that is biased by a restoring spring 107*a*. The arm of the lever 106 opposite to the follower 105 actuates a needle 109 that is movable but guided axially within a nozzle housing 113. The needle 109 has a conical tip 110 inserted in a nozzle orifice 111 that varies its exit cross section according to the settings of the flap 102 and/or the lever 106, the fuel exit nozzle 111 being connected to a fuel supply line 120 which delivers fuel under constant pressure. The constant pressure in the fuel supply line 120 may be achieved by means of a suitably elevated float chamber or by means of a fuel pump capable of delivering fuel at a constant pressure. A supply tube 131 delivering the idling fuel flow branches off from the fuel supply line 120, its fuel throughput being adjustable by a throttling member 132.

The fuel exit nozzle 111 and the idling supply tube 131 open into an air channel 114 connected by way of a line 112 to the intake pipe 101 at a point ahead of the throttle flap 104, but following the baffle flap 102, as viewed in the direction of air flow. This channel 114 has a cross sectional constriction 115 connected to the inlet line 116 of a fuel delivery pump 117. The fuel pump is followed by a distributor 118 and injection lines 119 leading to the intake ports associated with the several cylinders of the engine. As in the embodiment of FIG. 1, an air chamber may be added both following, as well as ahead of the fuel pump 117 to compensate the pulsations of the fuel pump.

As previously described in connection with the embodiment of FIG. 1, provision is made in the embodiment of FIG. 3 for the exit orifice of the fuel nozzle 111 to be aimed at the narrowest cross section of the constriction 115 in the air channel 114 and hence at the inlet line 116 of the fuel pump 117, to shorten the time of transport of the metered fuel and thus to ensure favorable dynamic performance of the engine.

According to the invention, it is further provided that the conical tip 110 of the needle 109 is not formed in a complicated shape, but rather has a constant change in radius over its length. The necessary dependent relationship for favorable engine performance upon the air throughout measured by the baffle flap 102 is effected by an appropriate shape of the cam 103. Such a cam, even if its outer surface is fairly complicated, can be manufactured with considerably greater ease and precision than a nozzle pin of correspondingly variable cylindrical cross section.

To achieve fuel enrichment during cold starting and warm-up of the engine, the bearing rod 108 of the lever 106 is made axially displaceable. This displacement may be effected by a temperature controlled servo drive 133 acting upon an end 130 of the bearing rod 108 so as to move it against the force of a restoring spring 122. In the rest position this spring draws a stop ring 123 on the bearing rod 108 into contact with the nozzle housing 113. When the engine is cold and during warm-up the displacement of the rod 108 lifts the lever 106. The end of this lever 106, which extends into the connecting pipe 112 and is movable, but sealed by means of an elastic bellows 121, lifts the nozzle pin 109 so that the exit cross section at the fuel exit nozzle is enlarged.

During these modes of operation, besides a greater flow of fuel, additional air must also be supplied to the combustion chambers of the engine. For this purpose a by-pass line is provided around throttle 104 in the embodiment of FIG. 3. This line is arranged between the connections 125 and 126 on the intake pipe 101 as is indicated schematically by a broken line 127. The by-pass 127 may also be controlled by the displaceable bearing rod 108. For this purpose the rod 108 may be provided in its midsection with a circumferential annular groove 128 engaging a matching lever arm of a block 124 pivoted on an axis 129. The block 124 is arranged so as to close the by-pass 127 in the rest position of the rod 108 and open the by-pass 127 at a setting associated with a cold start or warm-up operating mode of the engine.

Obviously the by-pass may alternatively be closed by means of a separate temperature-controlled mechanism, but the embodiment indicated in FIG. 3 provides for synchronization of the control of by-pass 127 with the enrichment of the fuel-air mixture delivered by the fuel pump 117 during cold starting and warm-up.

While there have been described what are believed to be the preferred embodiments of the present invention, those skilled in the art will recognize that various changes and modifications may be made thereto without departing from the spirit of the invention, and it is intended to claim all such embodiments as fall within the true scope of the invention.

We claim:

1. Apparatus for continuously injecting fuel into an internal combustion engine, wherein a main intake pipe includes an arbitrarily adjustable throttle flap arranged therein and a venturi disposed upstream of said throttle flap, said fuel injection apparatus comprising, in combination:

(a) an air channel connected at one end to said intake pipe at the narrowest point of said venturi and having at its opposite end a narrowed cross section forming an inlet for a fuel delivery pump;

(b) a fuel delivery pump connected to receive fuel mixed with air which passes through said narrowed cross section of said air channel, said pump being operative to supply a fuel-air mixture even under conditions of maximum engine load;

(c) fuel metering means for supplying fuel to said air channel in dependence upon air pressure in said air channel, said air pressure being dependent upon the pressure at said narrowest point of the venturi, said fuel metering means having fuel exit openings which are directed toward said narrowed cross section of said air channel; and (d) means responsive to the operating condition of the internal combustion engine for supplying additional air to said air channel for selectively raising the air pressure in said air channel, thereby to reduce the supply of fuel delivered from said fuel metering means to said air channel, the additional air supplying means being operable such that a mixture of both fuel and air is provided to said pump over the entire load range of said engine, wherein the additional air supplying means includes a nozzle communicating with atmosphere, said nozzle being arranged upstream of said fuel exit openings, and an adjustment means for controlling the internal cross section of the additional air nozzle in dependence upon the said operating condition of the internal combustion engine.

2. The fuel injection apparatus recited in claim 1, further comprising an air chamber connected to the fuel-air supply line on at least one side of said fuel delivery pump.

3. The fuel injection apparatus recited in claim 2, wherein said air chamber is connected on the inlet side of said fuel delivery pump.

4. The fuel injection apparatus recited in claim 2, wherein said air chamber is connected on the outlet side of said fuel delivery pump.

5. The fuel injection apparatus recited in claim 2, wherein an air chamber is connected on both the inlet and outlet sides of said fuel delivery pump.

6. The fuel injection apparatus recited in claim 2, wherein the air chamber includes a piston arranged to move within a cylinder, said piston being displaceable by air pressure against the force of a return spring.

7. The fuel injection apparatus recited in claim 1, further comprising a heating device arranged in said air channel at a point beyond said fuel exit openings, as viewed in the direction of fuel and air flow through said air channel.

8. The fuel injection apparatus cited in claim 7, wherein said heating device comprises electrical resistance heating elements.

9. The fuel injection apparatus recited in claim 1, wherein the fuel metering means includes (a) a main fuel supply tube projecting into said air channel;

(b) a main nozzle connected to said main fuel supply tube; and (c) a float chamber for supplying fuel to said main fuel supply tube via said main nozzle at a constant level.

10. The fuel injection apparatus recited in claim 9, further comprising a mixer tube projecting into said main fuel supply tube and receiving air from an air correction nozzle.

11. The fuel injection apparatus recited in claim 1, wherein the fuel metering means comprises a fuel injection tube projecting into said air channel which introduces an additional quantity of fuel supplied by an accelerator pump during acceleration of the internal combustion engine.

12. The fuel injection apparatus recited in claim 1, wherein the fuel metering means includes a second air channel connected to supply air to said first air channel, said second air channel being adapted to receive metered quantities of fuel for the idling and the transition modes of operation of the internal combustion engine.

13. The fuel injection apparatus recited in claim 12, further comprising a first, fixed throttle opening connected to said second air channel for supplying fuel thereto during idling operation, and a second, adjustable throttle opening connected to said second air channel for supplying fuel thereto during the transition operation of said engine, said first and second throttle openings receiving fuel under constant pressure from a fuel line.

14. The fuel injection apparatus recited in claim 13, further comprising an adjustable needle valve for controlling the amount of fuel passing through said second throttle opening.

15. The fuel injection apparatus recited in claim 12, wherein said second air channel is connected to the engine intake pipe at a point between said venturi and a starting choke flap, arranged ahead of said venturi as viewed in the direction of air flow through said intake pipe.

16. The fuel injection apparatus recited in claim 12, wherein said second air channel branches off from said first air channel at a point ahead of said fuel metering means, as viewed in the direction of air flow through said first air channel.

17. The fuel injection apparatus recited in claim 14, further comprising a pneumatically actuated negative pressure chamber for adjusting the position of said adjustable needle valve in dependence upon the pressure in said intake pipe in the region of said throttle.

18. The fuel injection apparatus recited in claim 14, further comprising cam drive means connected with said throttle flap for adjusting the position of said adjustable needle valve in dependence upon the position of said throttle flap.

19. The fuel injection apparatus recited in claim 12, wherein said second air channel branches off from a by-pass channel connected to said intake pipe and by-passing said venturi and said throttle flap, said by-pass channel having a blocking valve, responsive to the temperature of the engine, for controlling the air flow through said by-pass channel.

20. The fuel injection apparatus recited in any one of claims 9–14, further comprising a starter choke flap arranged in said intake pipe at a point ahead of said venturi, as viewed in the direction of air flow therethrough, said choke flap being controllable in dependence upon the position of said throttle flap.

21. The fuel injection apparatus recited in claim 1, further comprising an acceleration tube, connected to receive fuel from an acceleration pump and to supply said fuel directly to the fuel-air mixture delivered on the pressure side of said fuel delivery pump.

* * * * *